United States Patent [19]

Kochevar

[11] 4,220,336

[45] Sep. 2, 1980

[54] EXTRUDABLE WEIGHT CAPSULE

[76] Inventor: Rudolph J. Kochevar, 252 Arbolada Dr., Arcadia, Calif. 91006

[21] Appl. No.: 881,146

[22] Filed: Feb. 27, 1978

[51] Int. Cl.[3] ..... A63B 53/02

[52] U.S. Cl. ..... 273/80.8; 273/169

[58] Field of Search ..... 273/77 R, 80.2–80.8, 273/162 R, 162 B, 167–175; 46/DIG. 1; 272/93, 96

[56] References Cited

U.S. PATENT DOCUMENTS

| | | | |
|---|---|---|---|
| 1,889,743 | 12/1932 | Buhrke et al. | 273/80.8 X |
| 1,895,417 | 1/1933 | Lard | 273/80.8 X |
| 1,940,168 | 12/1933 | Hillerich | 273/80.6 |
| 2,541,851 | 2/1951 | Wright | 273/DIG. 29 |
| 2,846,228 | 8/1958 | Reach | 273/167 F X |
| 2,991,082 | 7/1961 | Handzlik | 273/80.8 X |
| 3,191,936 | 6/1965 | Guier | 273/80.2 |
| 3,356,782 | 12/1967 | Whyte | 273/171 X |
| 3,369,258 | 2/1968 | Smith | 46/DIG. 1 |
| 3,410,558 | 11/1968 | Reuter | 273/80.2 |
| 3,429,576 | 2/1969 | Ikeda | 273/162 B |
| 3,490,766 | 1/1970 | Gardner | 46/DIG. 1 |
| 3,625,513 | 12/1971 | Ballmer | 273/80.5 |
| 3,638,347 | 2/1972 | Kochevar | 43/44.81 X |
| 3,762,707 | 10/1973 | Santorelli | 273/80 B |

*Primary Examiner*—Richard J. Apley
*Attorney, Agent, or Firm*—Gordon L. Peterson

[57] ABSTRACT

An extrudable weight capsule comprising a mass of weight composition and a sheath for at least partially encasing the mass of weight composition. The mass of weight composition is generally of putty-like consistency and includes particulate metal and a binder. The mass of weight composition is readily permanently deformable. The weight capsule can be placed in a cavity of a member and compressively loaded to deform the weight capsule into intimate contact with the wall of the cavity.

22 Claims, 8 Drawing Figures

EXTRUDABLE WEIGHT CAPSULE

BACKGROUND OF THE INVENTION

Various manufacturing, maintenance and repair jobs call for internally weighting a member. For example, in the manufacture of golf clubs, it is necessary to accurately weight each club in order to provide a matched set of clubs.

A golf club typically includes a head having a tubular section and a tubular shaft. One end of the tubular shaft is received within the tubular section of the head and suitably affixed thereto. With this construction, a cavity is defined by the internal surfaces of the tubular shaft and the tubular section of the head. In order to weight the club, it is conventional practice to place a weight into the end of the tubular shaft remote from the head and allow such weight to travel through the passage in the shaft. The weight is then secured in place at or near the bottom of the passage.

One kind of weight which is used for weighting golf clubs is a resilient plug made of leaded rubber. Unfortunately, this rubber plug is not as heavy as desired and, because it is not permanently deformable, it does not conform to the shaft of the cavity in which it is placed. Consequently, when a golf club requires a relatively large magnitude of weight, these rubber plugs must be stacked one on top of the other in the shaft of the club. This is undesirable in that the weight should be provided as low down in the club as possible. In addition, a different diameter plug must be separately molded for each different shaft diameter, and it is difficult or impossible to provide fine adjustments in the weight.

It is also known to use solid metal plugs for weighting golf clubs. Although the solid metal plug can be made heavier than the rubber plug, it is otherwise subject to the same disadvantages noted above.

It is also known to use powdered lead and a cork-like device for retaining the powdered lead in the cavity. The powdered lead is difficult and dangerous to handle and requires the additional manufacturing operations of cork insertion and retention.

SUMMARY OF THE INVENTION

The present invention overcomes the disadvantages noted above by providing an extrudable weight capsule. The weight capsule is substantially heavier than the rubber plug and can be extruded or deformed into the same shape as the cavity in which it is placed. Consequently, for golf club weighting applications, the weight can be provided where desired, i.e., at the lowest possible location in the cavity. Because the weight capsule of this invention is readily manually moldable, the configuration of the weight capsule can be easily manually changed, and only one cross-sectional configuration needs to be manufactured. Finally, fine weight adjustments can be easily made.

The extrudable weight capsule includes a mass of weight composition and a sheath at least partially encasing the mass of weight composition. The mass of weight composition is easily manually moldable and is preferably of putty-like consistency. The putty-like consistency of the mass of weight composition makes it easily extrudable or deformable into the shape of the cavity in which it is placed. The putty-like consistency also permits fine weight adjustments to be made by manually pinching off or manually adding portions of the weight composition. Finally, the putty-like consistency allows the cross-sectional configuration of the mass of weight composition to be easily manually altered on the job to suit particular requirements. Consequently, the weight capsules can be manufactured in different standard weights, but the configuration, as manufactured, becomes less important because it is readily manually alterable in the field.

Because the purpose of the mass of weight composition is to provide weight, the weight composition is preferably dense. High density, coupled with a readily manually moldable characteristic, can be obtained by making the weight composition from a heavy particulate metal, such as powdered lead, and a binder for holding the particulate metal together.

The consistency of the mass of weight composition can be varied. However, it should be sufficiently soft and pliable so that its configuration can be manually changed perferably without the aid of tools. The mass of weight composition should be permanently deformable in the sense that it is capable of taking a permanent set after it has been deformed. Preferably, the mass of weight composition is sufficiently stiff so that when it is deformed against a shoulder of the cavity in which it is placed, it tends to interlock with that shoulder to tend to retain the weight composition in the cavity. The weight composition can be made relatively adherent so that it will adhere or tend to stick to the wall of the cavity in which it is placed.

The sheath can partially or fully encase the mass of weight composition. The sheath is constructed to permit the weight composition therein to deform when the weight composition is compressively loaded. For example, the sheath may rupture, deform, have openings or open up in response to compressive loading to permit deformation of the mass of weight composition therein.

Although the weight composition holds itself together in a mass, the sheath prevents inadvertent removal of portions of the mass so that the pre-established weight for the capsule remains unaltered during shipment and storage. If the mass of weight composition is made adherent, the sheath prevents the masses of weight composition from sticking together or to other objects during storage. The sheath facilitates handling of the capsule and maintains capsule integrity. If desired, the sheath may be constructed of a heavy deformable material, such as lead, so that it adds material weight to the capsule.

The sheath can be constructed of a resilient elastomeric material or a resilient plastic and completely or partially encase the mass of weight composition. This construction of the sheath will allow the mass of weight composition to deform while preventing contact between the composition and the wall of the cavity. This construction can be used, for example, when it is necessary or desirable to isolate the weight composition from the wall of the cavity in which it is placed.

In using the weight capsule, the capsule is placed in a cavity of a member. The capsule is then compressively loaded to extrude the weight capsule into intimate contact with the wall of the cavity. By providing a shoulder in the cavity, the weight capsule can be extruded into contact with the shoulder to interlock with the shoulder to tend to retain the capsule within the cavity. By way of example, and not by way of limitation, the member containing the cavity may be a golf club.

The invention, together with further features and advantages thereof, may best be understood by reference to the following description taken in connection with the accompanying illustrative drawing.

DESCRIPTION OF THE PREFERRED EMBODIMENT

Figure 5:
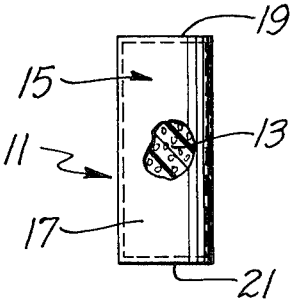
FIGS. 5-8 show, by way of example, four different embodiments of weight capsules constructed in accordance with the teachings of this invention.

FIG. 5 shows an extrudable weight capsule 11 which generally includes a mass 13 of weight composition and a sheath 15 for at least partially encasing the weight composition. The mass 13 of weight composition is preferably of high density and is readily permanently deformable. Preferably, the mass 13 of weight composition is of putty-like consistency and can be readily deformed. In the embodiment illustrated, the mass 13 is also somewhat adherent so that it tends to stick to whatever it is placed in contact with.

The sheath 15 can be of various configurations and of various materials, and the form shown in FIG. 5 is purely illustrative. However, the sheath 15 should be constructed to permit the mass 13 of weight composition to deform when the weight capsule 11 is compressively loaded. In other words, the sheath 15 should not prevent the deformation of the mass 13 of weight composition.

In the embodiment shown in FIG. 5, the sheath 15 forms a housing which completely encases the mass 13, and the mass 13 completely fills the housing. Thus, the sheath 15 includes a cylindrical peripheral wall 17 and end walls 19 and 21. With this construction, the weight capsule 11 is in the form of an axially elongated cylindrical slug; however, obviously other configurations may be employed.

In order to permit the mass 13 to be deformed, the sheath 15 may be constructed of a readily deformable or readily tearable material. For example, the sheath 15 may be constructed of a thin layer of lead, such as lead foil, which is suitably wrapped around the mass 13. The lead foil is not only easily deformed and ruptured, but it also is of high density and tends to add weight to the capsule 11. A thicker layer of material may be used for the sheath 15 so long as the weight capsule 11 is not made too difficult to deform as a result of the increased thickness. Alternatively, the sheath 15 may be constructed of a resiliently deformable plastic or elastomeric material.

The weight capsule 11 can be used to weight various members, such as a golf club 23. The golf club 23, which may be a wood or an iron, includes a head 25 having an integral tubular section 27 extending upwardly therefrom. The tubular section 27 has an internal bore 29 extending from the upper end of the tubular section 27 downwardly to terminate in an end wall 31.

The club 23 also includes a tubular shaft or shank 33 having an inner surface 34 defining an axial passage 35 extending completely through the shaft. The shaft 33 is received in the bore 29 with the lower end face 37 of the shaft being closely adjacent the end wall 31. The shaft 33 is suitably attached to the head 25 as by an adhesive.

With this construction, the end wall 31, the lower portion of the inner surface 34, the end face 37 and, if desired, a portion of the peripheral surface of the bore 29 define a cavity 39 within the club 23. The end face 37 forms an annular shoulder in the cavity 39.

In weighting the golf club 23, it is desirable to place the required amount of weight as low down in the cavity 39 as possible. This invention accomplishes this objective by providing a relatively heavy weight which completely fills the lower portion of the cavity 39.

Figure 1:
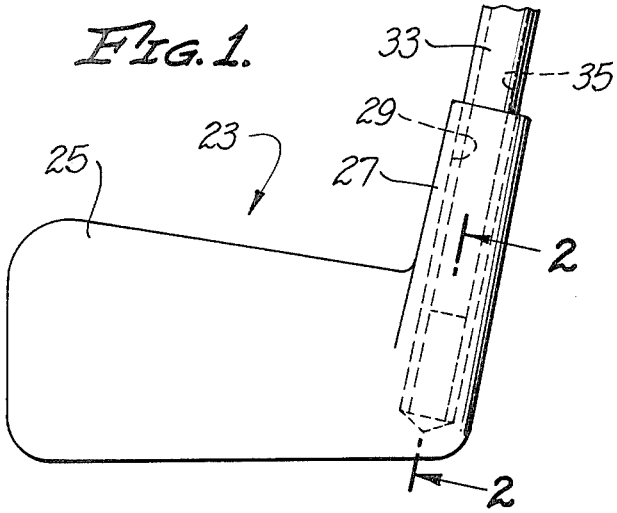
FIG. 1 is a fragmentary front elevational view of a golf club which has been weighted in accordance with the present invention.
Figure 2:
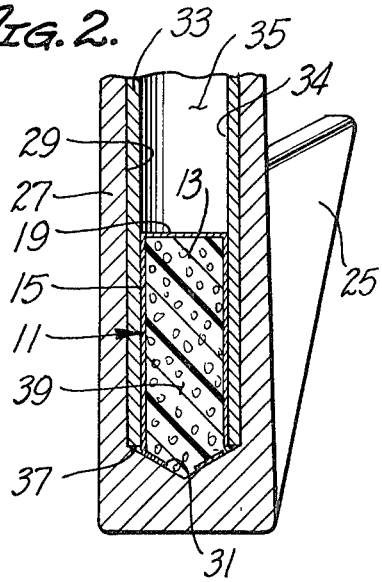
FIG. 2 is a fragmentary sectional view taken generally along line 2—2 of FIG. 1.
Figure 3:
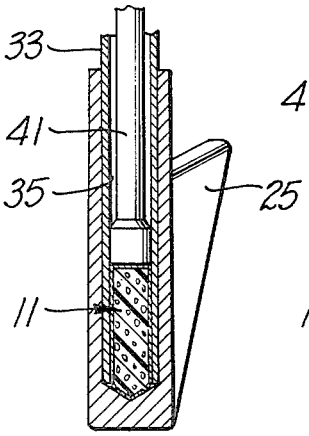
FIG. 3 is a view similar to FIG. 2 showing one way of deforming the weight capsule in the golf club.

To weight the club 23, the extrudable weight capsule 11 is placed into the passage 35 at its upper end and allowed to fall by gravity to the bottom of the cavity 39. A ram 41 is then extended into the shaft 33 as shown in FIG. 3 to axially compressively load the weight capsule 11. The compressive loading is sufficient to deform the weight capsule 11 into the configuration of the lower portion of the cavity 39 to completely fill the bottom portion of the cavity as best seen in FIG. 2.

The weight capsule 11 is deformed into intimate contact with the end face 37. As the weight capsule 11 is permanently deformable, it tends to remain in its deformed configuration so that the end face 37 cooperates with the deformed weight capsule 11 to retain the weight capsule in the cavity 39. In the embodiment illustrated in FIG. 5, it is assumed that the weight capsule 11 is deformed sufficiently so as to deform and rupture at least portions of the sheath 15, such as end wall 21. Accordingly, some of the mass 13 of weight composition contacts the walls of the cavity 39. In the embodiment illustrated, the mass 13 has a relatively adherent quality so that it tends to stick to the walls of the cavity 39. This further tends to hold the deformed weight capsule 11 in the cavity 39. The deformed weight capsule 11 automatically tends to be retained in the cavity 39 merely as a result of the deformation or extrusion of the weight capsule, and no separate capsule attaching step is necessary.

The capsule 11 should be sufficiently soft and pliable to be readily manually deformable by the ram 41 to fill the lower portion of the cavity 39 without exerting excessive force. On the other hand, the capsule 11 must be readily capable of retaining the configuration in which it is deformed into.

The weight capsule 11 can be provided in standard weights so that the amount of weight being added is known. In addition, on the job weight adjustment can be made by adding or removing some of the mass 13 of the weight capsule 11 because portions of the mass 13 can be pinched off or added to make fine weight adjustments. If necessary or desirable, more than one of the weight capsules 11 can be forced into the cavity 39.

Figure 6:
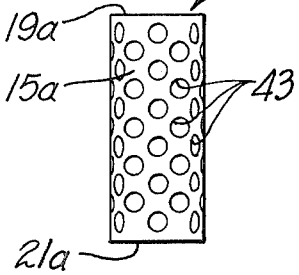
Figure 7:
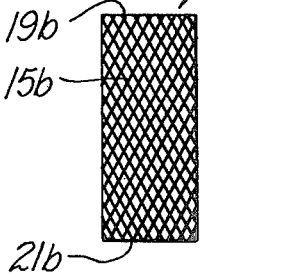
Figure 8:
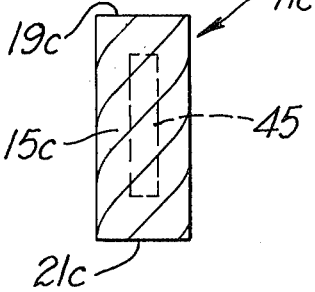

FIGS. 6-8 show weight capsules 11*a*, 11*b* and 11*c*, respectively. Portions of the weight capsules 11*a*–11*c* corresponding to portions of the weight capsule 11 are designated by corresponding reference numerals followed by the letters "a, b and c", respectively. The weight capsules 11*a* and 11*b* are identical to the weight capsule 11 in all respects, except for the construction of the sheaths 15*a* and 15*b*. The sheath 15*a* is identical to the sheath 15, except that it contains a large number of apertures 43 which facilitate the deformation of the capsule 11*a*, and in particular, the mass of weight composition. The sheath 15*a* has end walls 19*a* and 21*a* which also may have apertures therein.

In FIG. 7, the sheath 15*b* is constructed of a soft, pliable and readily rupturable wire mesh. The wire mesh may be constructed of lead or other suitable material. The end walls 19*b* and 21*b* of the sheath 15*b* may also be formed of the wire mesh.

In FIG. 8, the weight capsule 11*c* is identical to the weight capsule 11 in all respects, except for the sheath 15*c* and for the addition of a heavy, elongated, deformable metal element 45 of lead or similar material embedded in the mass of weight composition within the sheath 15*c*. In addition, the sheath 15*c* is made from a strip which is helically wound over the mass of weight composition. In this form of the invention, the sheath 15 may be open at the opposite ends or separate end walls 19*c* and 21*c* may be provided.

Figure 4:
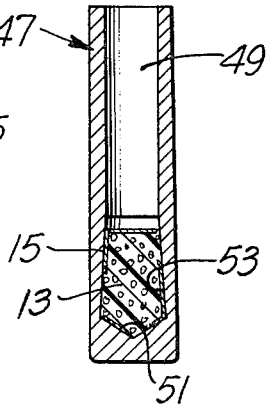
FIG. 4 shows another member having a cavity of a different configuration with the member being weighted in accordance with the teachings of this invention.

Of course, articles other than golf clubs can be weighted with the capsules 11–11*c*, and the capsules can be provided in cavities of various different configurations. For example, FIG. 4 shows a member 47 having an axial bore 49. The bore 49 has an end wall 51 and a frusto-conical peripheral wall 53 which widens as it extends downwardly. The weight capsule 11 has been deformed therein using a ram (not shown) so as to conform the weight capsule to the configuration of the bottom portion of the bore 49, as illustrated. As shown in FIG. 4, portions of the sheath 15 have ruptured to allow the necessary radial expansion of the mass 13. Of course, the capsules 11*a*–11*c* can be used in the same manner in the golf club 23 or in the bore 49 of the member 47 (FIG. 4).

Although various materials having the requisite properties can be utilized for forming the mass 13, it is preferred to utilize particulate material held together with a binder. The particulate material is preferably relatively heavy and may be powdered metal, such as powdered lead. The quantity of particulate matter can be varied depending upon the desired density of the mass 13.

The binder may include virtually any deformable material which will hold the particulate material together. Of course, the binder should be readily manually deformable. One suitable type of binder possessing these properties is beeswax. Of course, the quantity of binder must be sufficient to bind together all the particulate matter.

If it is desired that the mass 13 have adhering qualities, it should also contain a sticky or adherent material. One such material is polyisobutylene. The material added to provide the adhering quality also serves as a binder in that it tends to hold the particulate material together.

A suitable mass of weight composition may be made by using the following:

| Ingredient | Preferred Percent By Weight |
|---|---|
| Beeswax | 4% |
| Polyisobutylene | 6% |
| Powdered Lead (80 to 325 mesh) | 90% |

Of course, the proportions of these materials can be varied depending upon the results desired. Thus, the weight composition could be made more dense by utilizing a high proportion of powdered lead.

This weight composition can be prepared by melting the beeswax and polyisobutylene and then mixing these two ingredients together to form a homogeneous mass. The mixing can be accomplished with a mechanical stirring action. The powdered lead is then added, the mixture is stirred and then the weight composition is allowed to cool to solidify the liquid component thereof. The composition should be continuously stirred while it is cooling so that the powdered metal will be distributed evenly throughout the mass.

If desired, the weight composition set forth above may be colored. For example, this may be accomplished by using colored metal, such as red lead, copper, brass, etc., for the powdered metal. Alternatively, a small quantity of dye can be added to obtain the proper color. Care should be taken so that the dye added is compatible with the particular ingredients used to form the weight composition. Another way in which color can be obtained is to add small flakes or particles of colored material other than the powdered metal.

The mass of weight composition as described above may be made in accordance with the sinker composition disclosed in my U.S. Pat. No. 3,638,347. A suitable composition which can be used for weight composition may be purchased under the trademark SHAPE-A-WATE from Shape-A-Wate Company, P.O. Box 3082, Arcadia, Calif. 91006.

Although exemplary embodiments of the invention have been shown and described, many changes, modifications and substitutions may be made by one having ordinary skill in the art without necessarily departing from the spirit and scope of this invention.

I claim

1. An extrudable weight capsule adapted to be placed in a cavity of a member to weight such member, said extrudable weight capsule comprising:

a mass of weight composition of putty-like consistency;

said mass of weight composition including particulate metal and a binder for holding the particulate metal together;

said mass of weight composition being readily permanently deformable; and a sheath for at least partially encasing the mass of weight composition, said sheath being constructed to permit the mass of weight composition therein to deform when the mass of weight composition is compressively loaded whereby when the extrudable weight capsule is placed in the cavity and compressively loaded the mass of weight composition can permanently deform to fit at least a portion of the cavity.

2. An extrudable weight capsule as defined in claim 1 wherein said mass of weight composition has an adherent quality whereby when the weight capsule is deformed in the cavity the weight capsule tends to stick to the walls of the cavity thereby tending to retain the weight capsule in the cavity.

3. An extrudable weight capsule as defined in claim 1 wherein said sheath is constructed of readily deformable material whereby the sheath does not materially inhibit deformation of the weight composition.

4. An extrudable weight capsule as defined in claim 1 wherein said sheath has openings in the wall thereof.

5. An extrudable weight capsule as defined in claim 1 wherein said sheath is constructed of lead.

6. An extrudable weight capsule as defined in claim 1 wherein said mass of weight composition has adherent material therein whereby when the weight composition is deformed in the cavity the weight composition tends to stick to the walls of the cavity thereby tending to retain the extrudable weight capsule in the cavity and said particulate metal includes particulate lead.

7. An extrudable weight capsule as defined in claim 1 including a deformable metal element embedded in the mass of weight composition to add additional weight to the weight capsule.

8. An extrudable weight capsule as defined in claim 1 wherein said sheath has at least one end wall at least partially covering one end of the mass of weight composition and a peripheral wall at least partially covering the side periphery of the mass of weight composition.

9. An extrudable weight capsule as defined in claim 1 wherein said sheath is constructed of a resilient deformable material.

10. A weighted article comprising:

a member having an internal wall defining a cavity;

a mass of permanently deformable weight composition of predetermined weight in said cavity to add weight to said member, said mass of weight composition being deformed into intimate contact with the internal wall;

said mass of permanently deformable weight composition including particulate metal and a binder for holding the particulate metal together, said particulate metal being present in the mass of weight composition in an amount equal to at least about 90 percent by weight of the mass of weight composition; and said member being a golf club and including a head and a tubular shaft, said head including a tubular section having a passage terminating in said head and receiving an end portion of the tubular shaft, said cavity being in said passage of said tubular section.

11. A weighted article as defined in claim 10 wherein the mass of weight composition has a putty-like consistency and includes an adherent material mixed into said mass and providing said mass with an adherent quality.

12. A weighted article as defined in claim 10 wherein said particulate metal is lead.

13. A weighted article as defined in claim 10 wherein said shaft has an end face which defines a shoulder in said cavity, said mass of weight composition is deformed into contact with said shoulder whereby the contact between said mass of weight composition and said shoulder tend to retain the mass of weight composition in the cavity.

14. A weighted article as defined in claim 13 wherein the mass of weight composition has a putty-like consistency and includes an adherent material mixed into said mass and providing said mass with an adherent quality.

15. A weighted article as defined in claim 14 wherein said particulate metal is lead.

16. A method of making a weighted article comprising:

providing a member having an internal wall defining a cavity;

providing an extrudable weight capsule which includes a mass of weight composition, said mass of weight composition being readily manually moldable and being permanently deformable;

placing the extrudable weight capsule in the cavity;

compressively loading the extrudable weight capsule to deform the mass of weight composition sufficiently to permanently deform the weight capsule into intimate contact with the internal wall of the member; and the second-mentioned step of providing including providing a sheath for at least partially encasing the mass of weight composition and said step of compressively loading deforming the sheath.

17. A method as defined in claim 16 wherein said first-mentioned step of providing includes providing a shoulder in the cavity and said step of compressively loading includes deforming the weight capsule into contact with the shoulder to thereby tend to retain the weight capsule in the cavity.

18. A method of making a weighted article comprising:

providing a member having an internal wall defining a cavity;

providing an extrudable weight capsule which includes a mass of weight composition, said mass of weight composition being readily manually moldable and being permanently deformable;

placing a sufficient amount of the extrudable weight capsule in the cavity to give the article the desired weight;

compressively loading the extrudable weight capsule to deform the mass of weight composition sufficiently to permanently deform the weight capsule into intimate contact with the internal wall of the member; and said first-mentioned step of providing includes providing a head for a golf club and a tubular shaft for a golf club with said head including a tubular section and with the tubular section receiving one end of the tubular shaft, said step of placing including inserting the weight capsule into the other end of the tubular shaft and causing it to travel through at least a portion of said shaft to said tubular section, and said step of compressively loading including inserting a ram into said other end of the tubular shaft and against the weight capsule to compressively load the weight capsule between the internal wall and the ram to deform the weight capsule.

19. A method as defined in claim 18 wherein the second-mentioned step of providing includes providing a sheath for at least partially encasing the mass of weight composition and said step of compressively loading deforms the sheath.

20. A method of weighting a golf club comprising:

providing a golf club including a head and a tubular shaft, said head including a passage for receiving an end portion of said tubular shaft, said golf club having a cavity in said head with at least a portion of the cavity being withing said passage;

providing a mass of weight composition, said mass of weight composition being readily manually moldable and being permanently deformable;

placing a sufficient amount of the extrudable weight capsule in the cavity to give the golf club the desired weight;

inserting a ram into said tubular shaft; and compressively loading the mass of weight composition with said ram to permanently deform the mass into intimate contact with the wall of the cavity.

21. A method as defined in claim 20 wherein the shaft has an end face which defines a shoulder in said cavity and said step of compressively loading includes deforming the mass of weight composition into contact with said shoulder to thereby tend to retain the mass of weight composition in the cavity.

22. A weighted article comprising:

a member having an internal wall defining a cavity;

a weight capsule of predetermined weight in said cavity to add weight to said member;

said weight capsule being deformed into intimate contact with the internal wall;

said deformed weight capsule including a mass of permanently deformable nonvulcanizable weight composition of putty-like consistency;

said mass of permanently deformable weight composition including particulate lead and a binder for holding the particulate lead together; and said weight capsule including sheath material, said sheath material being deformed in said cavity.

* * * * *